US008515111B2

(12) United States Patent
Saito

(10) Patent No.: US 8,515,111 B2
(45) Date of Patent: Aug. 20, 2013

(54) IN-THE-EAR HEARING AID

(75) Inventor: Atsushi Saito, Tokyo (JP)

(73) Assignee: Rion Co., Ltd., Tokyo (JP)

( * ) Notice: Subject to any disclaimer, the term of this patent is extended or adjusted under 35 U.S.C. 154(b) by 894 days.

(21) Appl. No.: 12/126,294

(22) Filed: May 23, 2008

(65) Prior Publication Data

US 2008/0298616 A1 Dec. 4, 2008

(30) Foreign Application Priority Data

May 28, 2007 (JP) ..... 2007-139854

(51) Int. Cl.
*H04R 25/00* (2006.01)

(52) U.S. Cl.
USPC ..... 381/323

(58) Field of Classification Search
USPC ..... 381/322–324
See application file for complete search history.

(56) References Cited

U.S. PATENT DOCUMENTS 5,201,008 A * 4/1993 Arndt et al. ..... 381/323
6,228,020 B1 * 5/2001 Juneau et al. ..... 600/25
2001/0008560 A1 * 7/2001 Stonikas et al. ..... 381/322

FOREIGN PATENT DOCUMENTS

JP 2004-227980 A 12/2004

* cited by examiner

*Primary Examiner* — Jeffrey Donels
(74) *Attorney, Agent, or Firm* — Lee Fredric Sharra

(57) ABSTRACT

In an in-the-ear hearing aid forming an inner casing space with a shell 1 and a face plate 2, a protector 10 is provided to separate a battery housing space 8 and an inner shell space 9 which constitute the inner casing space. The face plate 2 forms an opening section 5 for loading and unloading a battery B and is integrally formed with battery contacting units 12, 13 by an insert molding method, while the protector 10 is provided to cover the battery B and is formed as a container with an opening section 10*a*, wherein the opening section 5 of the face plate 2 and the opening section 10*a* of the protector 10 are joined.

2 Claims, 2 Drawing Sheets

IN-THE-EAR HEARING AID

BACKGROUND OF THE INVENTION

1. Field of the Invention

The present invention relates to an in-the-ear hearing aid of which the battery housing section is provided with a waterproof construction.

2. Description of the Prior Art

In a conventional in-the-ear hearing aid provided with a waterproof construction, a battery housing section provided with a waterproof construction is known in which a rotatable battery holder is opened to allow the battery holder to hold a button type air battery and then, the battery holder is closed to house the button type air battery. The battery holder is composed of a battery holder core and an elastic cover member adapted to cover the battery holder and to cover and hold the button type air battery. When the battery holder is closed, the elastic cover member is compressively inserted between an opening section of a face plate and the battery holder core to serve as a packing (for example, refer to Patent Document 1).

Patent Document 1: Japanese Patent Application Publication No. 2004-227980

However, in the in-the-ear hearing aid disclosed in Patent Document 1, although the waterproof construction is provided at a contact section between a lid section of the battery holder and a surface of the face plate, a battery housing space communicates with an inner shell space because no partition is provided therebetween. Thus, there is a possibility that moisture such as sweat and water may infiltrate into the battery housing section when the battery holder is open. There is also a possibility that the moisture which has infiltrated into the battery housing section will run through battery contacting units to corrode a soldered section of electric parts disposed in the inner shell space.

SUMMARY OF THE INVENTION

It is therefore an object of the present invention to solve the problems seen in the prior art and to provide an in-the-ear hearing aid in which moisture such as sweat and water does not corrode a soldered section of electric parts even though the moisture has infiltrated into the battery housing section.

In order to attain this object, according to a first aspect of the present invention, an in-the-ear hearing aid forming an inner casing space with a shell and a face plate is provided, in which a protector is provided to separate a battery housing space and an inner shell space which constitute the inner casing space.

According to a second aspect of the present invention, the in-the-ear hearing aid of the first aspect is provided, in which the face plate forms an opening section for loading and unloading a battery and is integrally formed with battery contacting pieces by an insert molding method, while the protector is provided to cover the battery and is formed as a container with an opening section, wherein both the opening section of the face plate and the opening section of the protector are joined.

According to a third aspect of the present invention, the in-the-ear hearing aid of the second aspect is provided, in which parts of the battery contacting pieces straddling the battery housing space and the inner shell space are embedded within the face plate.

BRIEF DESCRIPTION OF THE DRAWINGS

The above and other objects, features and advantages of the present invention will become more apparent from the following description when taken in conjunction with the accompanying drawings.

DETAILED DESCRIPTION OF THE PREFERRED EMBODIMENTS

Figure 1:
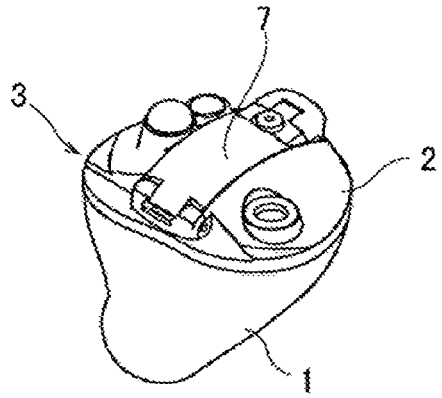
FIG. 1 is a perspective view of an in-the-ear hearing aid according to the present invention.
Figure 2:
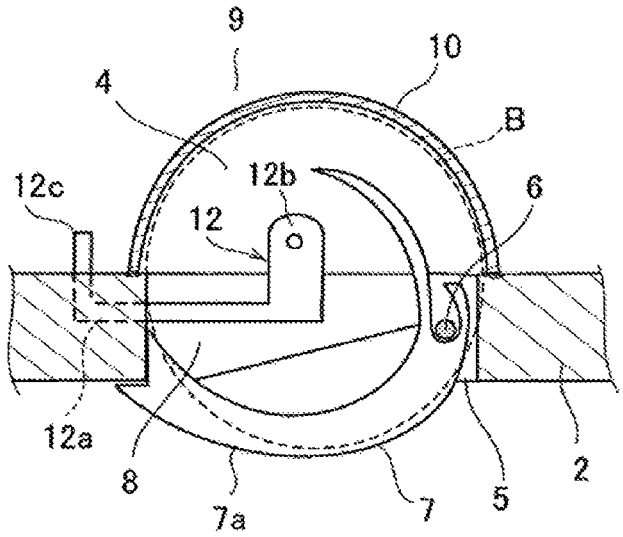
FIG. 2 is a cross-sectional view of an essential part of the in-the-ear hearing aid according to the present invention.
Figure 3:
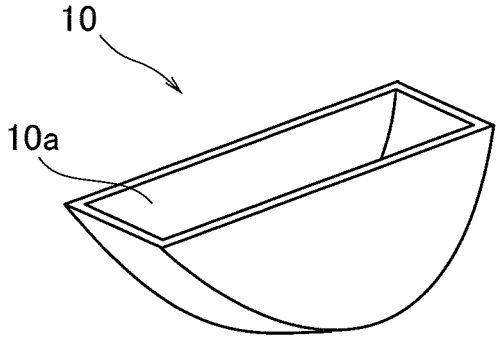
FIG. 3 is a perspective view of a protector.
Figure 4:
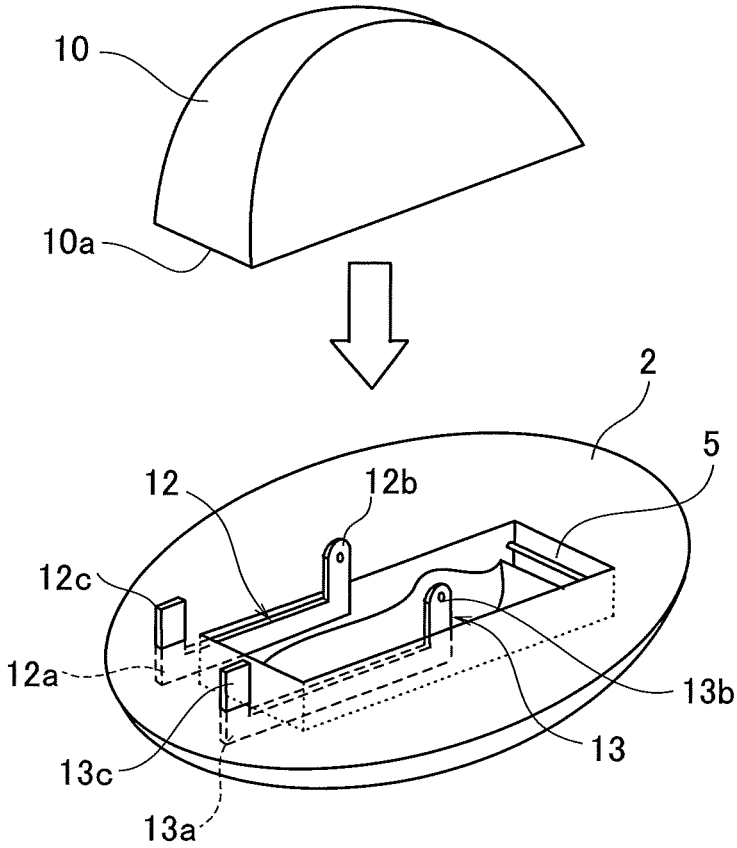
FIG. 4 is an explanatory view showing the assembly of the protector.

A preferred embodiment of the present invention will now be described with reference to the accompanying drawings. FIG. 1 is a perspective view of an in-the-ear hearing aid according to the present invention. FIG. 2 is a cross-sectional view of an essential part of the in-the-ear hearing aid according to the present invention. FIG. 3 is a perspective view of a protector and FIG. 4 is an explanatory view showing the assembly of the protector.

An in-the-ear hearing aid according to the present invention forms, as shown in FIG. 1, a case body 3 comprising a shell 1 made of resin and a face plate 2. A battery housing section for housing a button type battery is provided within the case body 3. Also disposed within the case body 3 are electric parts such as a microphone, a hearing-aid processing section and an earphone which constitute an hearing aid. The face plate 2 is integrally formed with battery contacting pieces described below by an insert molding method.

The face plate 2 is provided, as shown in FIG. 2, with an opening section 5 for loading a button type battery B into a battery housing section 4. A battery holder 7 for holding the battery B to be housed in the battery housing section 4 is rotatably provided around an axis member 6 formed in the vicinity of an edge of the opening section 5. A protector 10 for separating a battery housing space 8 and an inner shell space 9 which constitute an inner casing space is provided on a side where the opening section 5 faces the inside of the case body 3. Reference numeral 7*a* is a lid section of the battery holder 7.

The protector 10 is formed, as shown in FIG. 3, in a substantially semi-circular shape duplicating the battery shape, specifically as a container with an opening section 10*a*, to cover part of the button type battery B. It is to be noted that the protector 10 need not always be formed to duplicate the battery shape, but can be formed in other shapes, providing the battery B is covered. As shown in FIG. 2, in combination with FIG. 4, the protector 10 separates the battery housing space 8 and the inner shell space 9 by causing the opening section 10*a* of the protector 10 to adhere to the edge of the opening 5 of the face plate 2. Reference numerals 12, 13 are battery contacting units for supplying the electric parts disposed within the case body 3 with electric power.

As shown in FIGS. 2 and 4, parts 12*a*, 13*a* of the battery contacting units 12, 13 straddling the battery housing space 8 and the inner shell space 9 are embedded within the face plate 2, wherein one end 12*b*, 13*b* projects in the battery housing space 8 and the other end 12*c*, 13*c* projects in the inner shell space 9. The battery B contacts one end 12*b*, 13*b*, while electric wires and the like of the electric parts disposed in the inner shell space 9 are connected to the other end 12*c*, 13*c*. The parts 12*a*, 13*a* of the battery contacting units 12, 13 can be embedded in a shallow position on the same level as the surface of the inner shell side of the face plate 2.

In this manner, by embedding the parts 12*a*, 13*a* straddling the battery housing space 8 and the inner shell space 9 within the face plate 2, no space can be left to communicate between the battery housing space 8 and the inner shell space 9.

Operation of the in-the-ear hearing aid according to the present invention as constructed above will now be described. The battery holder 7 is opened to allow the battery holder 7 to hold the button type battery B, after which the battery holder 7 is closed. In this case, even though moisture such as sweat and water has infiltrated into the battery housing space 8, the moisture which has infiltrated into the battery housing space 8 does not penetrate the inner shell space 9 because the protector 10 completely separates the battery housing space 8 and the inner shell space 9.

Further, even though sweat has infiltrated from a space between the lid section 7*a* of the battery holder 7 and the face plate 2 when the in-the-ear hearing aid is used, the moisture which has infiltrated into the battery housing space 8 does not penetrate the inner shell space 9 because the protector 10 completely separates the battery housing space 8 and the inner shall space 9.

In this manner, even though moisture has infiltrated into a battery housing space 8 during use of the in-the-ear hearing aid or during loading of a battery, the moisture does not penetrate the inner shell space 9. Thus, a soldered section of electric parts disposed in the inner shell space 9 is not corroded.

EFFECTS OF THE INVENTION

According to the first aspect of the present invention, since the battery housing space and the inner shell space are completely separated by the protector, even though moisture such as water and sweat has infiltrated into the battery housing section, the moisture does not corrode a soldered section of electric parts disposed in the inner shell space.

According to the second aspect of the present invention, the battery housing space and the inner shell space can be separated by a simple construction.

According to the third aspect of the present invention, the battery housing space and the inner shell space can be separated with no space therebetween.

INDUSTRIAL APPLICABILITY

By providing a protector for separating a battery housing space and an inner shell space which constitute an inner casing space, even though moisture such as sweat and water has infiltrated into the battery housing section during use of the in-the-ear hearing aid or during loading of the battery, the moisture does not penetrate the inner shell space. Thus, a soldered section of electric parts is not corroded and reliability improves to contribute to expanded demand for the in-the-ear hearing aid.

What is claimed is:

1. An in-the-ear hearing aid forming an inner casing space with a shell and a face plate, wherein the face plate has an opening section and a protector adhering to the face plate opening section waterproofedly separates a battery housing space and an inner shell space which constitutes the inner casing space, wherein;

the face plate forms an opening section for loading and unloading a battery and is integrally formed with battery contacting units by an insert molding method, the protector is provided to cover the battery and is formed as a container with an opening section, and the opening section of the face plate and the opening section of the protector are joined; and a first end of each of the battery contacting units protrudes into the battery housing space and a second end of each of the battery contacting units protrudes into the inner shell space wherein each of the battery contacting units steps over the protector without penetrating the protector thereby preventing moisture from being transmitted from the battery housing space to the inner shell space.

2. The in-the-ear hearing aid according to claim 1, wherein parts of the battery contacting units straddling the battery housing space and the inner shell space are embedded within the face plate.

* * * * *